US011840084B2

(12) United States Patent
Galliker

(10) Patent No.: US 11,840,084 B2
(45) Date of Patent: Dec. 12, 2023

(54) VENTILATED PRINT HEAD

(71) Applicant: Scrona AG, Adliswil (CH)

(72) Inventor: Patrick Galliker, Richterswil (CH)

(73) Assignee: SCRONA AG, Adliswil (CH)

( * ) Notice: Subject to any disclaimer, the term of this patent is extended or adjusted under 35 U.S.C. 154(b) by 2 days.

(21) Appl. No.: 17/627,282

(22) PCT Filed: Jun. 22, 2020

(86) PCT No.: PCT/EP2020/067327
§ 371 (c)(1),
(2) Date: Jan. 14, 2022

(87) PCT Pub. No.: WO2021/008817
PCT Pub. Date: Jan. 21, 2021

(65) Prior Publication Data

US 2022/0242118 A1 Aug. 4, 2022

(30) Foreign Application Priority Data

Jul. 17, 2019 (WO) ..... PCT/EP2019/069212

(51) Int. Cl.
*B41J 2/14* (2006.01)

(52) U.S. Cl.
CPC ..... *B41J 2/1433* (2013.01); *B41J 2202/02* (2013.01)

(58) Field of Classification Search
CPC ..... B41J 2/1433; B41J 2202/02
See application file for complete search history.

(56) References Cited

U.S. PATENT DOCUMENTS

| | | | | |
|---|---|---|---|---|
| 4,403,234 | A | 9/1983 | Miura et al. | |
| 4,829,325 | A | 5/1989 | Iwasawa et al. | |
| 2009/0179939 | A1 | 7/2009 | Ide et al. | |
| 2011/0157610 | A1 | 6/2011 | Araszkiewiez | |
| 2014/0292934 | A1* | 10/2014 | Ozaki | B41J 2/14201 347/47 |
| 2015/0085014 | A1 | 3/2015 | Ishida et al. | |
| 2016/0257127 | A1 | 9/2016 | Arimizu et al. | |
| 2016/0257140 | A1 | 9/2016 | Miyakoshi et al. | |
| 2017/0217164 | A1* | 8/2017 | Kaneko | B41J 2/14233 |

(Continued)

FOREIGN PATENT DOCUMENTS

| | | |
|---|---|---|
| CN | 101868352 | 10/2010 |
| CN | 106604822 | 4/2017 |
| JP | 59-138461 | 8/1984 |

(Continued)

OTHER PUBLICATIONS

Int'l Search Report (Form PCT/ISA/210) conducted in Int'l Application No. PCT/EP2020/067327 (dated Aug. 19, 2020).

(Continued)

*Primary Examiner* — Jason S Uhlenhake
(74) *Attorney, Agent, or Firm* — GREENBLUM & BERNSTEIN, P.L.C.

(57) ABSTRACT

The print head includes a nozzle layer with a plurality of nozzles for printing ink onto a target. It further includes ventilation openings including blow openings for feeding a gas to the region between the nozzles and the target as well as suction openings for feeding gas away from this region. This allows maintaining a desired atmosphere at the region in order to better control the printing process.

34 Claims, 6 Drawing Sheets

(56) References Cited

U.S. PATENT DOCUMENTS

| | | | | |
|---|---|---|---|---|
| 2018/0009223 | A1* | 1/2018 | Poulikakos | B41J 2/06 |
| 2018/0170050 | A1* | 6/2018 | Chen | B41J 2/14072 |

FOREIGN PATENT DOCUMENTS

| | | |
|---|---|---|
| JP | 2011-005422 | 1/2011 |
| WO | 2016/169956 | 10/2016 |

OTHER PUBLICATIONS

Int'l Written Opinion (Form PCT/ISA/237) conducted in Int'l Application No. PCT/EP2020/067327 (dated Aug. 19, 2020).
China Search Report/Office Action conducted in counterpart China Appln. No. 202080051159 (dated Mar. 23, 2023).

* cited by examiner

VENTILATED PRINT HEAD

TECHNICAL FIELD

The invention relates to a print head for depositing ink on a substrate. The invention also relates to a printing system with such a print head and to a method for operating such a print head.

BACKGROUND ART

US 2018/0009223 describes an electrohydrodynamic print head having a nozzle layer comprising a plurality of nozzles. It is based on a structure where the nozzles are arranged on one side and feed ducts extend through a feed layer on the other side.

Nozzle electrodes are used to accelerate ink away from the nozzles and onto a target.

DISCLOSURE OF THE INVENTION

The problem to be solved by the present invention is to provide a print head of the type mentioned above that has improved printing quality.

This problem is solved by the print head of claim 1. Accordingly, the print head comprises a nozzle layer. This nozzle layer in its turn comprises at least the following parts:

a) A plurality of nozzles. These nozzles are structured to eject the ink onto a target. The ink may be any liquid that can be printed.

b) A plurality of ventilation openings extending through the nozzle layer.

The ventilation openings allow to feed a gas to the region between the printing head and the target and/or to convey gas away from said region. Hence, it becomes possible to control or at least modify the composition of the gas in the space where printing takes place, which provides a wealth of options for controlling the printing process. Some of these options are described below.

The ventilation openings advantageously comprise at least two types of openings: A first type is designed as suction openings for feeding gas away from the region adjacent to the nozzles. The second type is designed as blow openings for feeding gas towards said region.

The invention provides improved printing quality while suffering from less clogging problems. Particularly, the use of many nozzles on a flat multi-nozzle print head can result in the accumulation of evaporated liquid in the region between the print head and a target that is printed on. This problem is particularly pronounced for electrohydrodynamic multi-nozzle print heads like that disclosed in US 2018/009223 where printing resolutions can be in the sub-10 um, potentially even in the sub-1 um resolution regime. Furthermore, such print heads potentially allow the use of millions of nozzles arranged in large nozzle arrays, for example as disclosed in WO 2016/169956. Different from conventional ink-jet print heads, nozzles may be arranged in much larger numbers and in rectangular arrays that are largely of similar size along both main array axes.

In comparison, most ink-jet print heads are normally built such that nozzles are arranged within narrow rectangular or skewed rectangular areas, wherein a fast movement is exercised essentially in direction of the narrow dimension of said rectangular area. During such movement, a pixel position generally obtains a single or a very small number of droplets. Since the movement generally scans the whole width or length of the target, the residence time of the print head on top of a single droplet is very short and hence the printed droplets can dry while there is no print head on top of the target. The print head may only return for a second printing cycle once the previously printed droplets have fully dried.

In the use of an electrohydrodynamic print head, due to the high printing resolution, movement speeds are preferably smaller than those used for an ink-jet print head. Furthermore, the comparably large extension of the print heads in potentially all movement directions implies that the residence time of the print head above any equally large area on the target is large in comparison to the printing throughput. Hence, the print head may cover a given position on the target for much longer durations than what a single droplet would require drying. Hence, the presence of the print head and the many liquid-filled nozzles, as well as their printing output on the target, can strongly influence the drying behavior of deposited liquid. Given that the distance between the print head and the target is much smaller than the lateral dimension of the print head, this situation will generally result in the saturation of environment between print head and target with evaporated liquid. This can result in an evaporation blockage or at least in non-uniform evaporation due to the fact that the edge regions will have lower concentrations of evaporated liquid than the center positions of the print head. Both problems will strongly affect printing throughput and uniformity. The present invention provides a solution to allow a print head to operate even at long residence times.

As mentioned, the invention is particularly useful for large print heads, i.e. for print heads having an array of nozzles with a diameter that exceeds, in all directions, 1 mm, in particular 10 mm.

Advantageously, the print head comprises an array of nozzles. In said array, there is at least one ventilation opening per nozzle; in particular, there are at least two of them per nozzle. This allows maintaining a controlled microenvironment for each nozzle.

In one embodiment, the array can be divided into a plurality of identical unit cells, with each unit cell comprising at least one nozzle and the same arrangement of ventilation openings. In other words, the relative arrangement of the nozzle and the ventilation opening(s) is the same in each unit cell.

The print head is advantageously an electrohydrodymamic print head and comprises at least one nozzle electrode at each nozzle. The nozzle electrode can be positioned to electrohydrodynamically eject ink from the nozzle.

The print head may further comprise ventilation ducts connected to the ventilation openings in order to convey gas between the ventilation openings and as least one gas source and at least one gas sink.

The print head may further comprise electrically conductive vias extending through at least part of the ventilation ducts, which allows using the ventilation duets not only for transporting gas but for transporting electricity, too.

The invention also relates to a method for operating the print head that comprises at least the following:

printing an ink onto a target by means of said nozzles and conveying a gas through said ventilation openings.

The printing and conveying advantageously takes place concurrently for increased printing speed.

As mentioned, some of the openings may be blow openings while others may be suction openings. In this case, the method may advantageously comprise:

feeding gas away from a region at said nozzles through said suction openings and feeding gas to said region through said blow openings.

This allows locally exchanging the gas at the nozzles. Advantageously, gas is fed away from the region and fed to the region at the same time in order to maintain a steady exchange of gas.

Furthermore, there is advantageously introduced a temperature difference between print head and the target. Because of this temperature difference, there will be a difference in vapor pressure between liquid deposited on the target and liquid contained within the nozzle in the print head. This pressure difference causes a diffusive motion of evaporated liquid from the higher towards the lower pressure region. Advantageously, the higher pressure (i.e. higher temperature) region is on the target and the lower pressure (i.e. lower temperature) region is on the print head. Hence, to cause evaporated liquid to move away from the substrate towards the print head, such print head is advantageously at a lower temperature than the substrate.

However, if evaporated liquid moves from the target towards the print head, due to a temperature difference, this can readily lead to an over-saturated environment at the print head surface and therefore to condensation of liquid on the print head. Especially an electrohydrodynamic print head may be rendered completely non-functional due to this. However, condensation can be prevented if the gas introduced through blowing-type ventilation openings can dissolve evaporated liquid that was previously printed onto the substrate. Such liquid-concentrated gas may then be removed through suction-type ventilation openings.

Advantageously, introduced gas therefore contains less than 50% saturation, more advantageously less than 20% saturation, of the at least one liquid used for printing. In this way condensation of liquid on the print head can be prevented, although through proper choice of temperature difference and gas flow minimal condensation conditions may be upheld. This is viable because condensation does not immediately occur on the print head even at over-saturated conditions, due to thermodynamic energy barriers associated with the formation of a liquid nucleus, i.e. a growth center, on a dry surface. In comparison, condensation into the liquid formed within the nozzle is readily possible. Therefore, the nozzle can compensate for an over-saturated environment by absorbing small amounts of liquid through condensation.

Condensation onset on dry parts is advantageously further reduced by coating the print head surface with Teflon or another liquid repellant material.

The combination of temperature difference and gas flow can result in fast removal of liquid from the target, thereby allowing more ink to be printed per time unit.

Here, the word "ink" advantageously describes a combination of liquid carrier and a contained material to be deposited. The material can be dispersed, dissolved or otherwise stabilized in the liquid. Upon printing of the ink and evaporation of the liquid carrier only the deposited material will remain.

Generally, the contained material is dedicated to be formed into structures of given size, for example into a line of a certain width and height. If ink is deposited into such a line at a high volumetric flow rate, this can result in widening of the line due to liquid accumulation. As a result, a lower volumetric flow rate must be chosen. As an alternative to decreasing volumetric flow rate, it may be advantageous to increase evaporation rate by introducing a gas circulation between the ventilation openings and, advantageously, by additionally introducing a lower temperature at the print head than at the target. The latter additionally allows to specifically control evaporation rates at the nozzle and the target. Advantageously, evaporation at the print head is close to zero or even slightly negative (i.e. slight condensation occurs), which implies that the concentration of contained material within the ink at the nozzle position remains almost constant, thereby reducing the problems associated with clogging or first droplet effects.

Importantly, if each nozzle has associated at least one ventilation opening all nozzles will have very similar environments in terms of the concentration of gas-dissolved liquid. If, for example, gas would be blown underneath the print head, from one side of the print head towards the other, of between ventilation openings that are separated by several nozzles, such gas would have a higher concentration of liquid where it exits as compared to where it entered (because it continuously takes up liquid along its way underneath the print head). Accordingly, the situation for nozzles at the entry and exit point will not be the same and this can result in a different drying speed and different clogging vulnerability and to non-uniform printing results.

Hence, the invention also relates to a printing system including a print head of this type as well as a target holder and at least one temperature control device for heating or cooling the print head and/or the target holder. In particular, the system comprises a print head temperature control device for cooling the print head and/or a target temperature control device for heating the target holder.

Similarly, the method of the present invention may advantageously comprise the step of controlling the temperature of at least one of the print head and the target holder.

Advantageously, the target is maintained at a higher temperature than the print head, in particular with a temperature difference between the target and the print head of at least 10° C., in particular of at least 30° C.

Also, the temperature of the target is advantageously heated, such as to at least 80° C., for supporting in-situ tempering of the deposited material.

The print head is advantageously operated as an electrohydrodynamic print head, i.e. electrical fields from the nozzle electrodes of the print head are used to eject ink from the nozzles during printing.

BRIEF DESCRIPTION OF THE DRAWINGS

The invention will be better understood and objects other than those set forth above will become apparent when consideration is given to the following detailed description thereof. This description makes reference to the annexed drawings, wherein.

MODES FOR CARRYING OUT THE INVENTION

Definitions

A "unit cell" of an array of nozzles and ventilation openings is the smallest group of nozzles and ventilation openings having the overall symmetry of the array, and from which the entire array can be built up by repetition in two dimensions.

Terms such as above, below, top, bottom are to be understood such that the nozzle layer is arranged at the bottom side of the print head with the nozzles' ejection direction being downwards.

Horizontal designates the directions parallel to the planes of the nozzle layer. Vertical designates the direction perpendicular to the plane of the nozzle and layer.

General Setup

Figure 1:
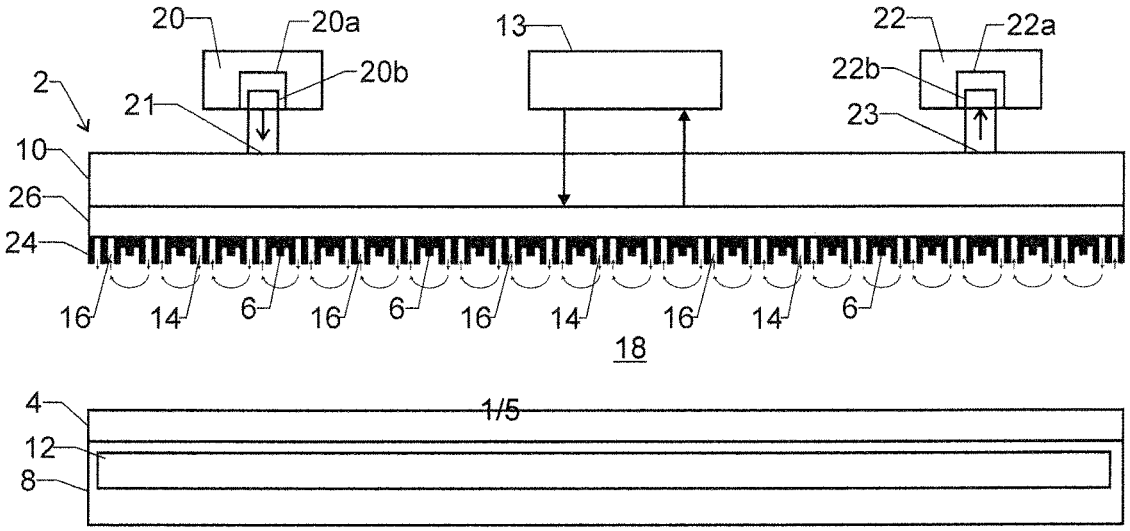
FIG. 1 is a schematic side view of a printer with the print head and the target.

FIG. 1 illustrates a general setup of an embodiment of the invention. It shows a print head 2, which is used to print ink onto a target 4.

Print head 2 has e.g. the basic design as described in US 2018/0009223 and comprises an array of nozzles 6 for ejecting inks. As described in more detail in an embodiment below, nozzle electrodes located at the nozzles 6 are used to electrohydrodynamically eject ink droplets from the nozzles 6 and an acceleration electrode accelerates ink from the nozzles onto target 4.

A target holder 8 is arranged below print head 2 and adapted to hold target 4 at a distance of e.g. 0.1 to 2 mm below print head 2. Target holder 8 may e.g. form said acceleration electrode.

In this example the acceleration electrode is associated with the target 4 such that between the two flat surfaces of target 4 and print head 2 a uniform electric can form which accelerates the droplets ejected from any nozzle 6 in perpendicular direction to the print head 2 surface towards target 4 where they are being deposited.

Print head 2 may comprise, and/or be thermally connected to, a print head temperature control device 10, and target holder 8 may comprise, and/or be thermally connected to, a target temperature control device 12 to expedite the drying of the ink on substrate 8, by introducing a temperature gradient between print head 2 and target 4.

Temperature control devices 10, 12 may include a resistive heater or a Peltier element or remote heating or cooling of a liquid which passes through the temperature control device 10, 12.

In any case, also passive heating or cooling may be employed, e.g. to bring either print head or target, or both, to room temperature.

In an advantageous embodiment, print head temperature control device 10 is adapted to cool or heat the ink itself. For example, the ink may be cooled or heated outside print head 2 and then fed into print head 2.

For better temperature control, the ink may be recirculated before being printed. In other words, and as illustrated in FIG. 1, the printing system may comprise a circulation pump 13 connected to print head 2 for circulating ink through print head 2, advantageously with the ink being temperature-controlled by print head temperature control device 10. Part of the circulated ink is branched off to the nozzles 6 for printing.

There may also be used a combination of techniques for heating and/or cooling. For example, there could be used a Peltier element for heating or cooling a block of metal or other material with good thermal conductivity, such as Aluminum Nitride, with this block being in contact to the feed layer 26. At the same time, this block may be passed by the ink in which case the ink takes up the temperature of the block before entering the feed layer 26.

Advantageously, the print head temperature control device 10 sets the print head 2 temperature such that it is lower than the temperature set at the target 4 by the target temperature control device 12. In this way, higher liquid evaporation rates are created at the target 4 than at the print head 2. It is understood that both the absolute temperature at print head 2 and target 4 may be above or below room temperature, while still the print head 2 is at a lower temperature than the target 4 in comparison. For example, the temperature at print head 2 may be chosen 50° C. while the temperature at the target 4 may be chosen to be 100° C. Such high temperatures at target 4 may be chosen in order to not only enhance evaporation of solvent upon droplet impact but in addition the temperature at the target may also introduce some sort of in-situ temperature sintering of the deposited material contained within the ink. Furthermore, it is possible to adjust for solvents of different vapor pressure. For example, a lower boiling point liquid may be operated with a lower median temperature than a higher boiling point liquid, wherein median temperature described the intermediate temperature between target 4 and print head 2.

As described in more detail in the following, print head 2 comprises a plurality of ventilation openings, which include blow openings 14 and suction openings 16.

The blow openings 14 are used to feed gas to a region 18 below the nozzles 6. The suction openings 16 are used to feed gas away from region 18.

A gas source 20 may comprise a pump or pressure reservoir, and optionally a mass flow controller 20*a* connected in series to an inlet 21 of the print head. Alternatively or in addition thereto, the gas sink 22 may comprise a vacuum pump or low pressure reservoir, and optionally a mass flow controller 22*a* connected in series to an outlet 23 of the print head.

Advantageously, the mass flow controller comprises a mass flow sensor, a pressure regulator, and a fast switching piezo valve 20*b*, 22*b* connected in series. The piezo valve is used for fast on/off switching of the gas source to the inlet or gas sink to the outlet. The steady state gas flow is controlled by the pressure regulator, using the mass flow sensor as feedback device. The pressure at the pressure regulator may also be set above the requirements for the steady state flow, to improve transient behavior.

Consequently, the piezo valve is operated in a linear proportional mode or a pulse width modulated mode to limit and control the steady state flow. The pressure regulator can be entirely omitted by using two fast switching piezo valves in a half-bridge configuration and a pressure sensor, applying the aforementioned in a linear proportional or pulse width modulated driving mode.

Fast switching of the gas flow between on-state and idle state of the print head is beneficial because the gas flow is advantageously adjusted to the printing flow rate and drying speed of ink on the target 4. For example, upon finalization of a print, printing flow rate may rapidly go to zero, in which case the gas flow is advantageously reduced to zero as well, in order to not accelerate evaporation of liquid from the nozzle. Commercial mass flow controllers enable precise gas flow control and settling times in the order of 100 milliseconds. Faster switching and settling times in the order of 1 to 10 milliseconds or even below 1 millisecond are achieved with piezo valves.

In more general terms, the printing system of the present invention may include at least one mass flow controller for regulating (i.e. measuring and maintaining at a desired level) the mass flow of the gas passing through the ventilation openings 14, 16 and/or a valve 20*b*, 22*b* for controlling the flow of the gas.

Print head 2 comprises a nozzle layer 24, which includes the nozzles 6 as well as the nozzle electrodes, and feed layer 26. Feed layer 26 forms feed ducts for feeding ink to the nozzles as well as ventilation ducts connecting the ventilation openings 14, 16 to their respective gas source 20 and gas sink 22.

Nozzle and Ventilation Opening Geometry

The arrangement of the nozzles 6 and the ventilation openings 14, 16 can affect the trajectory of the ink through region 18, as well as the drying behavior of ink at substrate and nozzle and it should therefore be designed with care.

Figure 2:
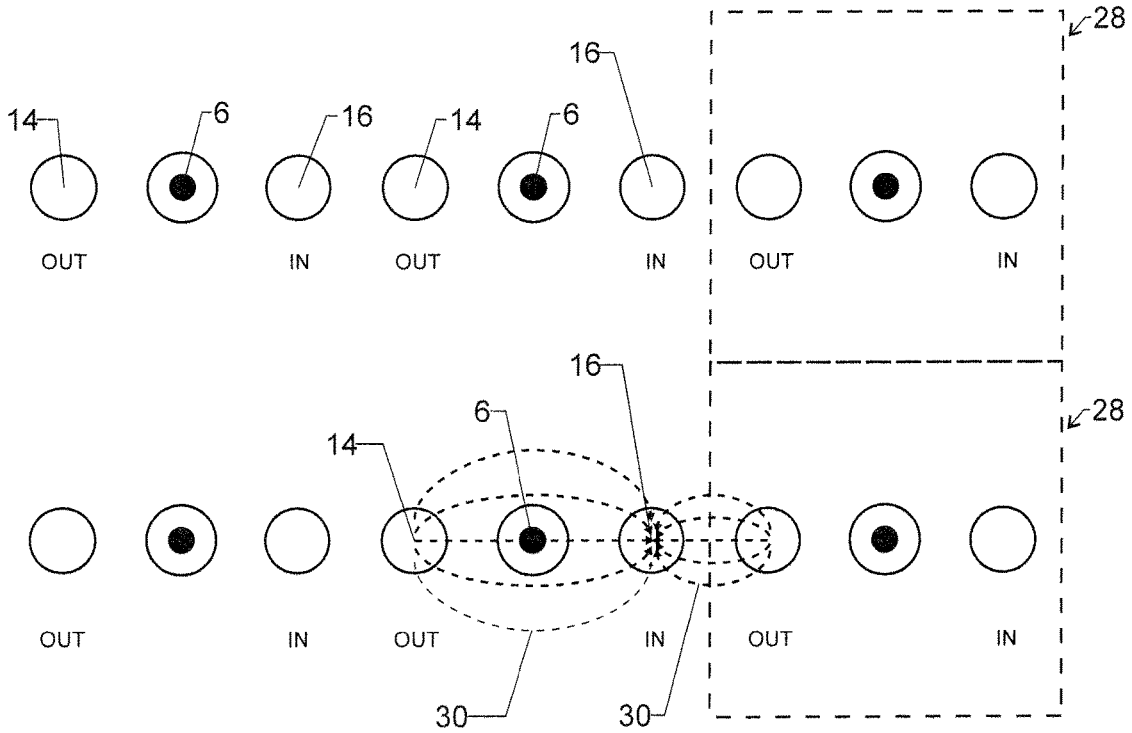
FIG. 2 shows a first arrangement of nozzles and ventilation openings as seen from the bottom of the print head.

FIG. 2 illustrates a first embodiment, which corresponds to the design illustrated in FIG. 1. Here, each nozzle 6 is arranged between one blow opening 14 and one suction opening 16 (i.e. on the connecting line between the blow opening 14 and the suction opening 16). Advantageously, the nozzle 6 is arranged at the center between these two ventilation openings 14, 16.

FIG. 2 shows two rows of nozzles 6 and ventilation openings 14, 16 extending parallel to each other. It depicts only a small part of the array of nozzles 6 and ventilation openings 14, 16 of the array.

As can be seen, the array can be divided into a plurality of unit cells 28. FIG. 2 illustrates two such unit cells 28, each surrounded by a dotted square.

Each unit cell 28 advantageously comprises at least one nozzle 6, at least part of a blow opening 14, and at least part of a suction opening 16 in order to generate a controlled, local gas flow around the nozzle 6.

In the embodiment of FIG. 2, each unit cell 28 contains exactly one nozzle 6, its neighboring blow opening 14 and its neighboring suction opening 16.

The gas flow generated by the ventilation openings 14, 16 is illustrated by dashed arrows 30. In particular, there is a basically linear gas flow across the exit of nozzle 6. It will tend to deflect the ink exiting from the nozzle, but since the gas flow is the same at all nozzles, the deflection caused by it merely results in a linear offset of all the ink deposited on substrate 8.

Figure 3:
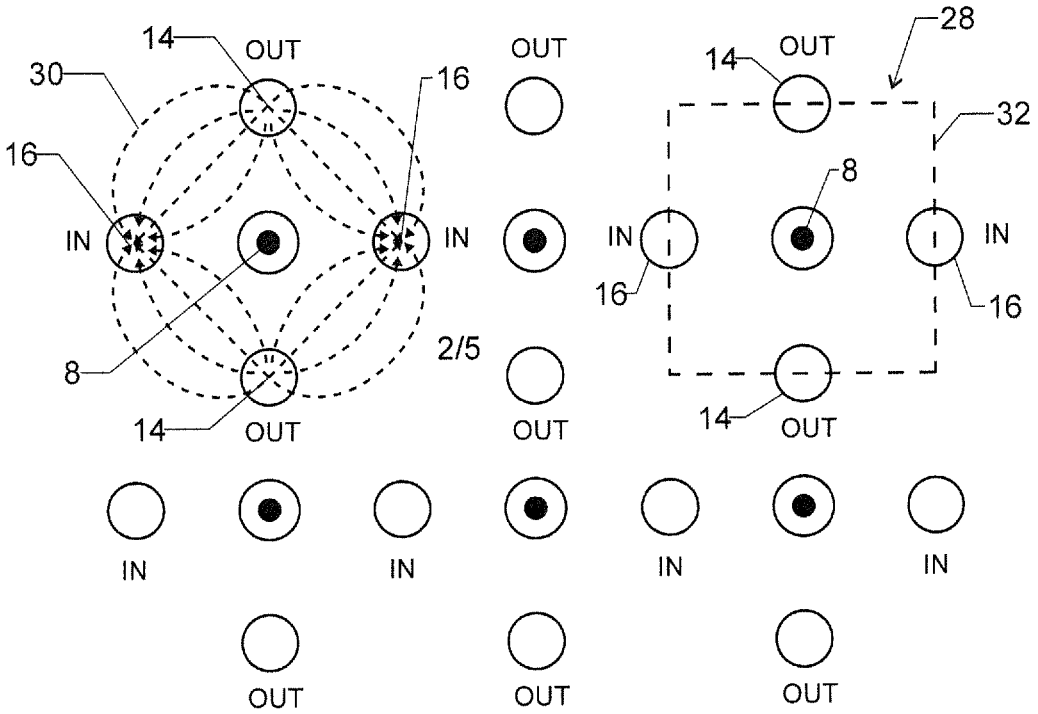
FIG. 3 shows a second arrangement of nozzles and ventilation openings as seen from the bottom of the print head.

FIG. 3 shows another embodiment of the arrangement of nozzles 6 and ventilation openings 14, 16.

Here, each unit cell 28 consists of two halves a blow opening 14 and two halves a suction opening 16 alternatingly arranged at the centers of the edges of a square 32 (which coincides with the border of unit cell 28) and one nozzle 6 in the center of square 32.

In this design, and as illustrated in FIG. 3, there is no direct gas flow 13 across the nozzle 6, which reduces the deflection of the ink ejected by the nozzle. This is beneficial because even a uniform deflection force as caused in the first embodiment of FIG. 2 can introduce problems, for example if the distance between print head and substrate is not the same for all nozzles. In this case, some droplets will be deflected for a longer duration than others, which will introduce a relative offset in their impact position on the substrate. Distance variations may be caused by improper alignment between print head and substrate surfaces but potentially also by the existence of surface topography located at the substrate. Hence, the embodiment of FIG. 3 may be regarded superior to the embodiment of FIG. 2.

Figure 4:
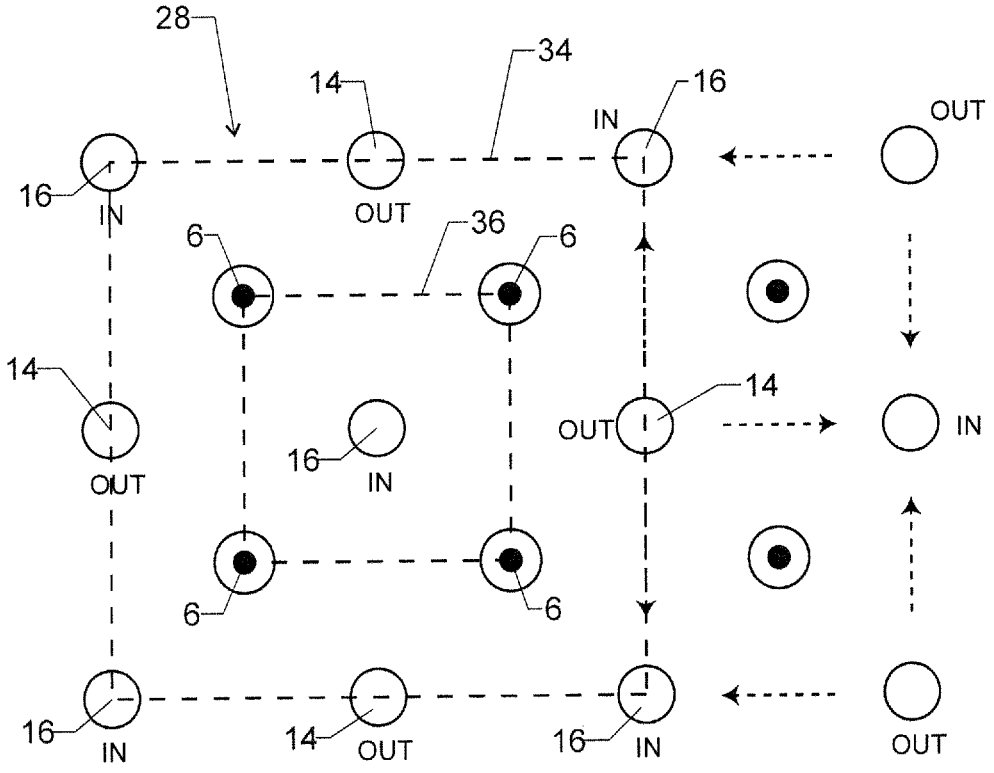
FIG. 4 shows a third arrangement of nozzles and ventilation openings as seen from the bottom of the print head.

FIG. 4 shows a third embodiment of the arrangement of nozzles 6 and ventilation openings 14, 16.

Here, each unit cell 28 consists of four quarters of suction openings 16 at the corner of a first square 34, four halves of blow openings at the middle of the edges of the first square 34, and one suction opening 16 in the center of the first square 34. Further, the unit cell includes four nozzles 6 at the corners of a second square 36. The first and second squares 34, 36 have parallel edges and are concentric, and the first square 34 has twice the diameter of the second square 36.

In this case, the gas flow around two neighboring nozzles 6 is of opposite direction. However, since there is (similar to the embodiment of FIG. 3) no gas flow directly across the nozzles 6, the consequences of this asymmetry are small.

It must be noted that the unit cell 28 in the embodiment of FIG. 4 may also be offset by one nozzle distance (e.g. to the right in the figure). In that case, each unit cell 28 consists of four quarters of blow openings 14 at the corner of first square 34, four halves of suction openings 16 at the middle of the edges of first square 34, and one blow opening 14 in the center of the first square 34. In other words, the unit cell can be described in more than one way, with the descriptions being interchangeable in that they describe the same physical arrangement of the nozzles 8 and the ventilation openings 14, 16.

This illustrates that there is typically more than one way to describe such a unit cell, and for fulfilling a claimed unit cell type it is sufficient that a given physical arrangement can be divided into unit cells of a claimed unit cell type.

In the embodiments of FIGS. 2 and 3, there are two ventilation openings 14, 16 for each nozzle 8 while, in the embodiment of FIG. 4, there is only one ventilation opening 14, 16 for each nozzle 8. Hence, the density of nozzles in the embodiment of FIG. 4 can be larger than in the embodiments of FIGS. 2 and 3.

Print Head Design

FIGS. 5-8 illustrate a possible design of the nozzle layer 24 and the feed layer 26 of a print head 2.

The design of the nozzles 6 in nozzle layer 24 substantially corresponds to the design of the device described in US 2018/0009223.

In particular, each nozzle 6 comprises a spout 40 arranged in a recess 42. At a level below spout 40, at least one nozzle electrode 44 surrounds recess 42 and is used to extract ink away from a liquid meniscus formed at spout 40. In the shown embodiment, the nozzle electrodes 44 are annular (cf. FIG. 8).

In the shown embodiment, an optional shield electrode 46 is arranged at a level below the nozzle electrodes 44. It covers substantially all the array of nozzles 6 with the exception of openings at the location of each nozzle 6 and helps to shield the influence of nozzle electrodes 44 of neighboring nozzle 6 and to maintain a uniform electrical field in region 18.

Nozzle layer 24 may comprise a first dielectric sublayer 48 between the electrodes 44, 46 and a second dielectric sublayer 50 right above the nozzle electrodes 44. A third dielectric sublayer 52 forms the spouts 40. A fourth dielectric sublayer 54 forms a carrier membrane of the spouts 40 for positioning and holding each spout 40 at the center of its recess 42.

Feed layer 26 forms feed ducts 56*a*, 56*b* for feeding ink to the nozzles 6. In the embodiment shown, they include via sections 56*a* extending vertically upwards from the nozzles 6 and horizontal interconnect sections 56*b*. The latter run e.g. perpendicular to the sectional plane of FIG. 5, and each of them interconnects a plurality of the via sections 56*a*. The interconnect sections 56*b* may be connected to larger ink terminals of print head 2, where an ink reservoir may be connected to them.

The ventilation openings 14, 16 are connected to ventilation ducts 58*a*, 58*b*, 58*c*, which extend through print head 2 to ventilation terminals 60, which can be connected to the gas source 20 and to the gas sink 22.

In the shown embodiment, the ventilation ducts 58*a*, 58*b*, 58*c* include chimney sections 58*a*, which extend from the ventilation openings 14, 16 vertically through at least part of print head 2, in particular through nozzle layer 24 and at least part of feed layer 26.

Further, the shown ventilation ducts 58*a*, 58*b*, 58*c* include two sets of interconnect ducts 58*b*, 58*c*, each of which interconnects a plurality or all of the ventilation openings 14, 16.

Advantageously, and as shown, the interconnect ducts 58*b*, 58*c* advantageously extend horizontally through print head 2.

In the shown embodiment, the first set 58*b* of interconnect ducts interconnects the blow openings 14, and the second set 58*c* of interconnect ducts interconnects the suction openings 16 (or vice versa). The two sets form distinct duct systems for feeding gas to the blow openings 14 and for feeding gas away from the suction openings 16. Hence, in this example an arrangement of ventilation openings is shown that is essentially equal to that shown in FIG. 3.

Advantageously, the first and second set of interconnect ducts 58*b*, 58*c* are located at different vertical levels in the print head, which makes it easier to keep them separate. In any case, after forming the interconnect ducts 58*b*, the 58*c*, a single vertical ventilation duct may be formed to continue gas flow to the next higher level of the feed layer 26. In this way, space is created for the formation of interconnect ducts of different gas pressure (i.e. dedicated to suction of blowing) or of horizontal interconnect sections carrying ink. This can be important for other embodiments than that shown in FIG. 3.

Figure 5:
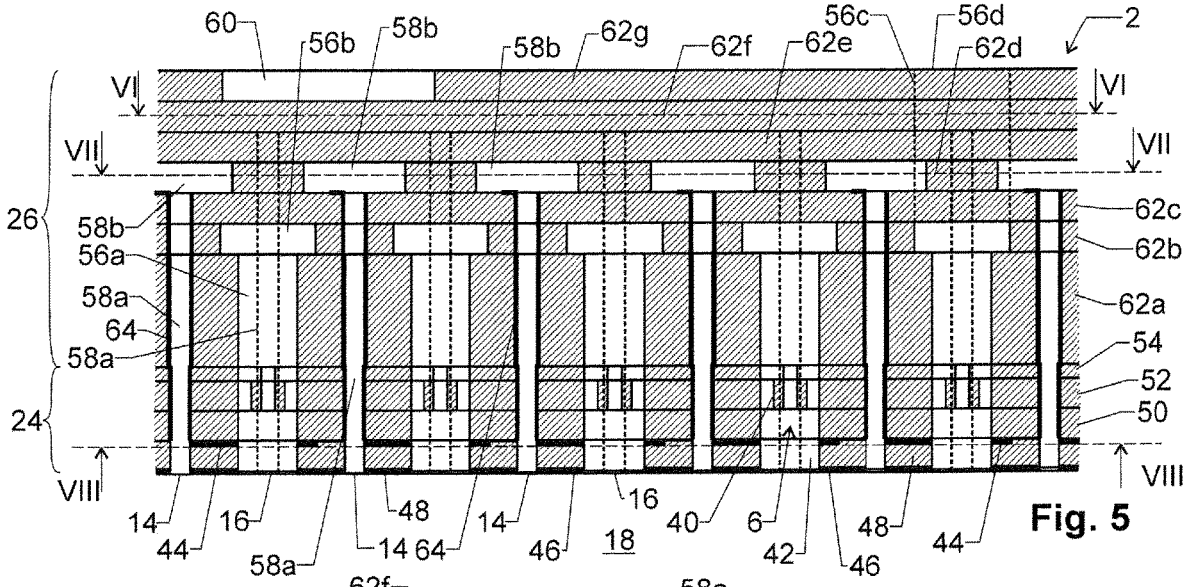
FIG. 5 is a sectional view of a print head.
Figure 6:
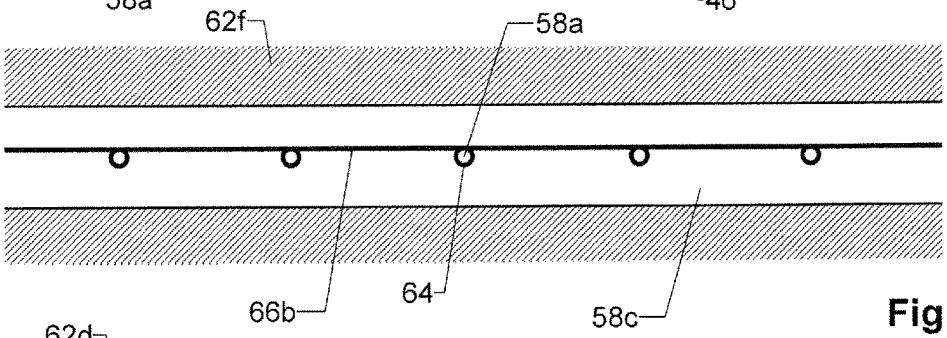
FIG. 6 is a sectional view along line VI-VI of FIG. 5.
Figure 7:
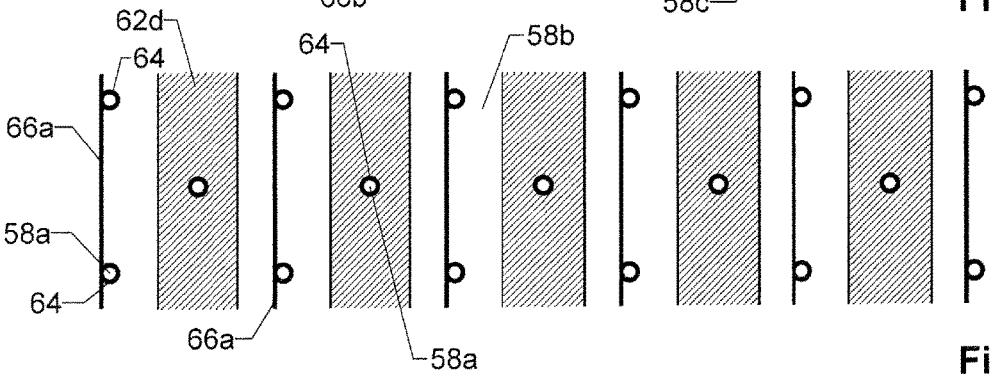
FIG. 7 is a sectional view along line VII-VII of FIG. 5.

For example, the embodiment of FIG. 4 would not allow interconnection of the ventilation ducts 58*a* of either suction or blowing type, without passing over of ventilation ducts 58*a* of the other type (i.e. blowing or suction) or over feed ducts 56*a*. To succeed with the interconnection anyway, one can first interconnect via section 56*a* by horizontal interconnect section 56*b* as it is shown in FIG. 5. By freeing the space previously occupied by the many via sections 56*a*, one would then be able to interconnect ventilation ducts 58*a* on a higher sublayer of the feed layer 26.

The reduction in the number of ventilation ducts 58*a* towards the higher sublayers of the feed layer 26 eventually reduces to at least one ventilation terminals 60.

However, such reduction implies that the distance of any two blow openings 14 or suction openings 16 to the respective inlet 21 or outlet 23 (see FIG. 1) may vary between individual openings. To have equivalent gas flow through the different blow openings 14 or suction openings 16, it is advantageous to make sure that the pressure drop takes place majorly through the thin channels of the blow openings 14 or the suction openings 16 or through any other channel that is uniform across the whole print head 2. In the embodiment of FIG. 5 this includes chimney sections 58*a*.

This may e.g. be achieved by adjusting the average cross-section and length of uniform ventilation ducts, e.g. chimney section 58*a*, as compared to their non-uniform counterparts, e.g. of the interconnect ducts 58*b*, 58*c*. A smaller cross-section and longer length of a given ventilation duct thereby implies a higher pressure drop. Hence, one way of achieving appreciable results is by reducing the diameter of the blow openings 14 and the suction openings 16 until the pressure drop over uniform parts of the ventilation ducts on averages varies less than a certain percentage. Preferably, such percentage is less than 25% across all blow openings 14 and suction openings 16, more preferably less than 5%.

In more general terms, operating the print head advantageously comprises at least one of the following steps:

feeding a gas through at least one inlet 21 of the print head 2 to a plurality of blow openings 14 of the print head 2, wherein the flow resistance of the gas between the at least one (21) and the blow openings 14 varies by less than 25%, in particular less than 5%, over (i.e. for) all said blow openings 14, and/or feeding a gas from suction openings 16 of the print head through at least one outlet 23 of the print head 2, wherein the flow resistance of the gas between the suction openings 16 and the at least one outlet 23 varies by less than 25%, in particular less than 5%, over (i.e. for) all said suction openings 16.

Advantageously, equivalent procedures are executed also when designing the feed ducts 56*a*, 56*b* and the diameter of the nozzles 6. In this case the relevant flow is the flow of liquid through the nozzle 6 when ejecting liquid.

In the shown embodiment, feed layer 26 comprises several sublayers, which are advantageously of a dielectric material in order to insulate the various electrically conductive tracks within feed layer 26 (to be described below).

A first sublayer 62*a* forms the via sections 56*a* as well as part of the chimney sections 58*a*.

A second sublayer 62*b* forms the interconnect sections 56*b* of the ink feed ducts for the ink. The chimney sections 58*a* extend through this second sublayer 62*b*.

A third sublayer 62*c* covers second sublayer 62*b* and closes the interconnect sections 56*b* from above. The chimney sections 58*a* extend through this third sublayer 62*b*.

The third sublayer 62*b* may also form at least one via section from each interconnect section 56*b*. The same via section may also extend upwards into each of the higher sublayers until there is formed an opening in the topmost layer which allows contacting to an ink source via an ink terminal. In the present example, one such via section 56*c* and the respective ink port 56*d* are illustrated, in dotted lines. This exemplifies that after interconnecting feed ducts only few via sections need to be effectively formed all the way to the topmost layer.

A fourth sublayer 62*d* forms the first set 58*b* of interconnect ducts for the gas to the blow openings 14. The chimney sections 58*a* associated with suction openings 16 extend through this fourth sublayer 62*d*

A fifth sublayer 62*e* covers fourth sublayer 62*d* and closes the interconnect ducts 58*b* from above. The chimney sections 58*a* associated with suction openings 16 extend through this fourth sublayer 62*e*.

A sixth sublayer 62*f* forms the second set 58*c* of interconnect ducts for the gas from the suction openings 16.

The sixth sublayer 62*f* may also form at least one chimney section from each interconnect duct of the first set of interconnect ducts 58*b*. The same chimney section may also extend into each of the following upper sublayers, until there is formed an opening in the topmost layer in the form of a gas terminal 60 (not shown).

A seventh sublayer 62*g* covers sixth sublayer 62*f* and closes the second set of 58*c* interconnect ducts from above. It may also form one or more of the gas terminals 60.

As mentioned, there are several electrically conductive tracks in print head 2 and in particular in feed layer 26 in order to connect the various electrodes to one or more voltage sources of the printer.

They may include suitable electrical vias extending through some or all of the sublayers of the print head.

In one particularly advantageous embodiment, print head 2 may contain electrically conductive vias 64 extending at least through part of the ventilation ducts 58*a*, 58*b*, 58*c*. In particular, such electrically conductive vias 64 may extend along at least some of the chimney sections 58*a*. They may e.g. be formed by an electrically conductive coating extending along at least part of the wall of the respective chimney section 58*a*.

Figure 8:
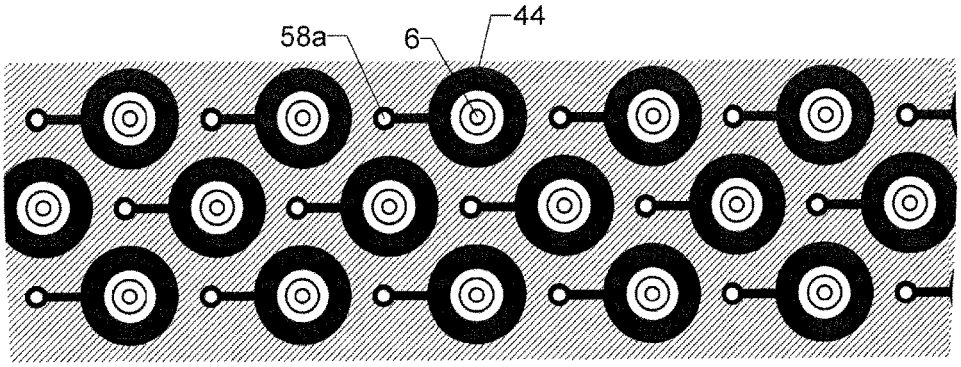
FIG. 8 is a sectional view along line VIII-VIII of FIG. 5.

The conductive vias 64 may be connected to the nozzle electrodes 44 as shown in FIG. 8. In order to have different nozzle electrodes 44 connected to at least two different voltage sources, one half of the vias 64 may be connected to a first set of electrically conductive interconnect lines 66*a*, e.g. at top surface of sublayer 62*c* (see FIG. 7), while the other half of the vias 64 may be connected to a second set of electrically conductive interconnect lines 66*b*, e.g. at the top surface of sublayer 62*e*.

It must be noted that electrically conducting vias 64 in chimney sections 58*a* may also be used, in addition or alternatively to the above application, to feed voltage to any other electrode(s) in print head 2, such as to shield electrode 46.

If the print head is to be brought to a specific temperature, it is advantageous to at least form some of the electrical vias 64 as separate vias which are completely filled with metal, e.g. by electroplating or by printing a metal ink into the voids. Particularly, a metal with good thermal conductivity like copper can be used to fill such vias. In this way, the temperature implied onto the print head by a cooling or a heating device is efficiently forwarded to the nozzle layer, across the dielectric layers of the feed layer which by definition do not have very good thermal conductivity properties.

As can be seen, nozzle layer 24 of print head 2, as well as feed layer 26, form a single, integral body. They may e.g. be manufactured using masking and etching steps as they are known from semiconductor technology.

Particularly feed layer 26 may be made by stacking and patterning of permanent dry film resist, e.g. epoxy-based dry film resist, or from individual patterned glass sheet, particularly laser-patterned glass sheets, which are bonded together, e.g. by adhesive bonding.

Print Head Operation

The print head is operated by applying suitable voltage pulses to the nozzle electrodes 44 in order to eject ink from the nozzles 6 onto target 4.

At the same time, or at times different from the actual printing steps, gas is conveyed through the ventilation openings 14, 16.

Advantageously, the steps of printing the ink and conveying the gas are concurrent even though they may also take place intermittently as described for an example below.

Advantageously, the flow rate of gas conveyed through the blow openings 14 to region 18 (e.g. the gas volume conveyed each second into region 18) and the flow rate of gas conveyed through the suction openings 16 from region 18 (e.g. the gas volume conveyed each second from region 18) are equal. This helps to keep the gas composition in region 18 homogeneous and avoid lateral gas flows towards the edges of region 18, which might deflect the ink segments, e.g. in droplet-form, passing it.

It must be noted, though, that the flow rates through the blow openings 14 and the suction openings 16 need not be equal. In fact, one type of ventilation openings (either the blow openings or the suction openings) may even be dispensed with completely while it is still possible to ventilate region 18 by relying on a global horizontal gas exchange at the edges of region 18. In that case, for example, region 18 may be flooded with fresh gas from the blow openings 14, or it may be flooded with fresh gas drawn in horizontally from the edges of region 18 while the old gas is removed by means of the suction openings 16. In this embodiment, printing may advantageously be interrupted while operating the gas flow in order to avoid asymmetric deflection caused by the gas flow in region 18.

Also, when printing is interrupted altogether, the gas flow is advantageously deactivated while the temperature difference between print head 2 and target 4 is upheld. In case gas flow continuous after printing discontinuation, the lack of liquid on the target implies that the gas flow will end up supporting removal of liquid from the nozzle, due to the absence of a diffusive gas flow from the target towards to print head. To support persistence of the nozzle against clogging, a gas may be switched from a partially saturated to a fully saturated species.

The gas conveyed to region 18 through the blow openings 14 may fulfill one or more of the following functions:

- The gas may be used for drying, i.e. for conveying evaporated ink solvent or ink carrier away from region 18. In this case, the ink comprises a component that is evaporated on target 4, and the concentration of said component is lower in the gas fed through the blow openings 14 to region 18 than in the gas evacuated through the suction openings 16.
- The gas may be an inert gas preventing undesired chemical reactions of the ink with air. For example, the gas may include nitrogen or a Nobel gas.

It is understood that the gas can also be used for both, to support drying and introduce a chemically inert environment

Edge Flow Control

Figure 11:
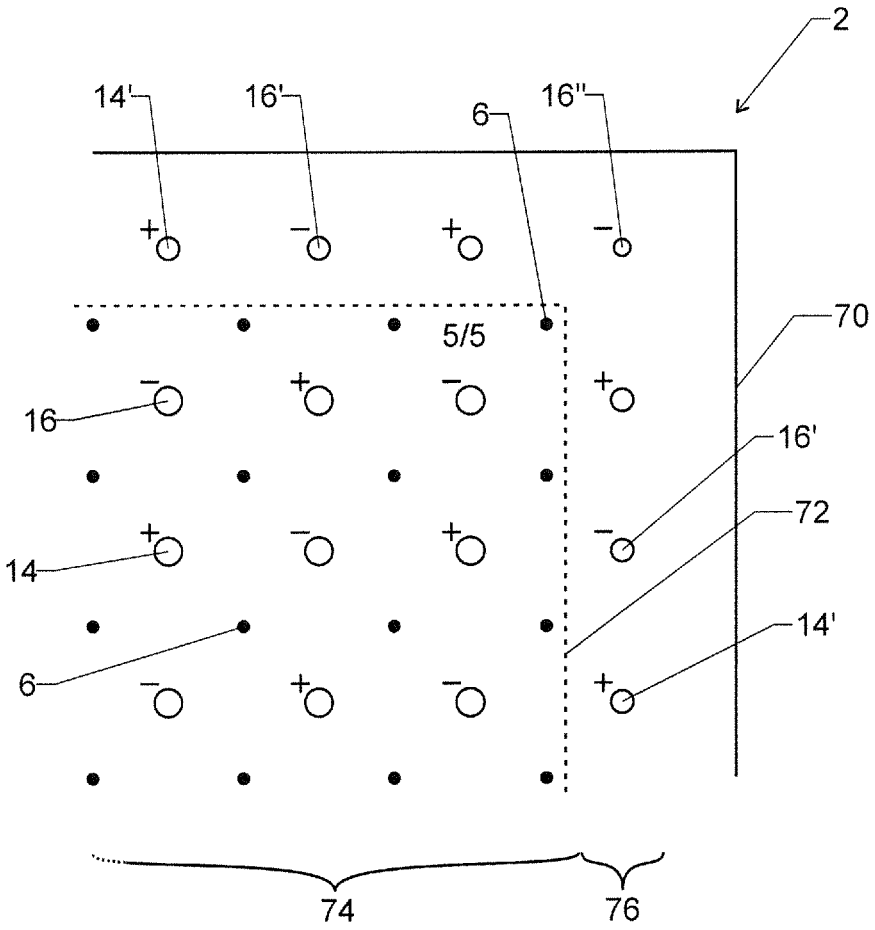
FIG. 11 shows a first embodiment with edge flow compensation.

FIG. 11 shows another advantageous technique for a print head 2 with ventilation openings 14, 16. It is illustrated, by way of example, for the geometry of nozzles 6 and ventilation openings 14, 16 of FIG. 3, but it can be combined with any of the embodiments described herein.

The figure depicts the edge region of the print head, with reference number 70 denoting, symbolically, two edges of the print head. For simplicity, the blow openings 14 are denoted by a plus sign and the suction openings 16 by a minus sign. The nozzles 6 are represented by small, black dots.

FIG. 11 further shows the outer border 72 of the active nozzles 6. In the figure, the nozzles 6 to the left of the border 72, in a core region 74 of print head 2, are structured thus that they can be activated for printing. When printing, they are being activated to eject ink.

In a region outside border 72, namely in an edge region 76, there are no activatable nozzles, but there is a plurality of blow openings 14 and/or suction openings 16.

Advantageously, and as shown, in edge region 76, blow openings 14 and/or suction openings 16 extend along a row, in particular along a single row, parallel to border 72.

In more general terms, the print head advantageously comprises a core region 74 with activatable nozzles 6 and ventilation openings 14, 16 and an edge region 76, surrounding the core region 74, with ventilation openings 14', 16' but no activatable nozzles 6, with a (virtual) border 72 between them.

In the embodiment of FIG. 11, there is exactly one row of ventilation openings 14', 16', 16"surrounding core region 74.

These ventilation openings 14', 16', 16" have, in the embodiment of FIG. 11, smaller diameter than the ventilation openings 14, 16 in core region 74, thereby generating a smaller gas flow rate. This design takes into account that the ventilation openings 14', 16', 16" along the edge have fewer neighboring ventilation openings than those in core region 74. Thus, reducing the gas flow through them makes the flow pattern of the print head more homogeneous at the location of the outmost active nozzles 6.

In general terms, the print head is adapted and structured to generate a smaller gas flow rate through at least some of the ventilation openings 14', 16', 16" in the outmost row than through the ventilation openings 14, 16 in the core region 74.

In particular, the outmost ventilation openings 14', 16' along the edges (but not the ventilation openings 16" at the corners) outside core region 74 have, in the embodiment of FIG. 11, have only three instead of four neighboring ventilation openings, and therefore the gas flow through them is advantageously approximately 75% of the gas flow through the ventilation openings 14, 16 in the core region. Similarly, the gas flow through the ventilation openings 16" outside the corners of core region 74 should advantageously be adapted to have approximately 50% of the gas flow through the ventilation openings 14, 16 in core region 74.

In FIG. 11, the gas flow reduction is implemented, as mentioned, by a diameter reduction of the outmost ventilation openings 14', 16', 16". The amount of diameter reduction depends on the length and geometry of ventilation openings and the ventilation ducts and can be calculated using numerical simulation and/or approximating calculations.

Alternatively to reducing the diameter of the ventilation openings 14', 16', 16", the diameters of the ventilation ducts leading to these ventilation openings may be reduced.

In yet another embodiment, separate gas sources and/or gas sinks can be provided for core region 74 and edge region 76, with the latter having lower pressure for lower gas flows than the former.

Figure 12:
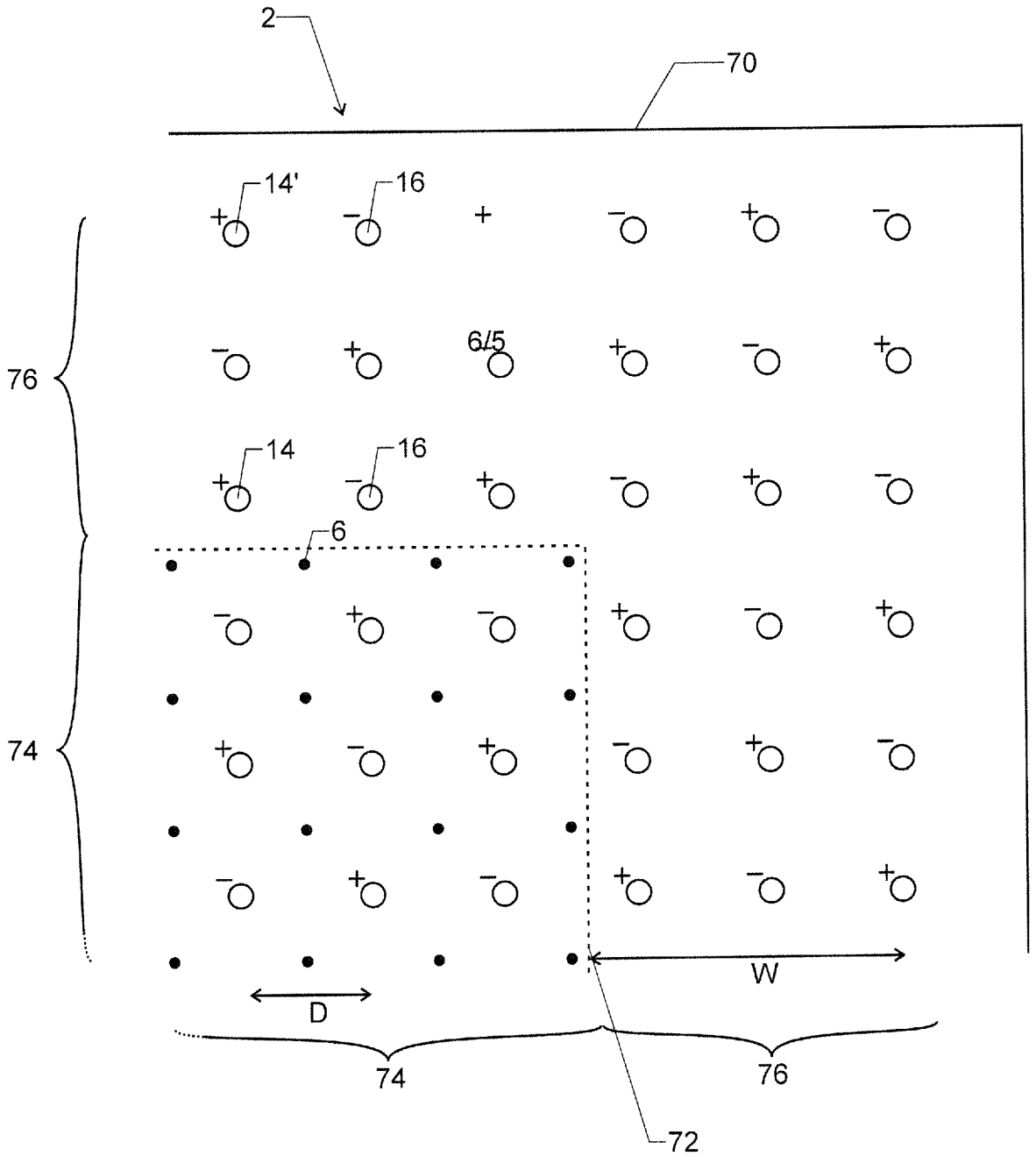
FIG. 12 shows a second embodiment with edge flow compensation.

FIG. 12 shows another design for reducing inhomogeneous gas flow at the edge of core region 74.

Here, edge region 76 is several rows of ventilation openings deep, but the ventilation openings 14', 16' in edge region 76 advantageously have the same gas flow (at least close to border 72) as those in core region 74.

The distance W from the border 72 to the outmost ventilation openings 14', 16' of the edge region 76 (i.e. those ventilation openings of edge region 76 that are farthest away from border 72) is at least two times, in particular at least five times, the average inter-nozzle distance D of in core region 74 along the direction perpendicular to border 72.

In the case of the embodiments of FIGS. 11 and 12 and any other embodiments having an edge region without activatable nozzles, the method for operating the print head advantageously comprises not ejecting any ink from edge region 76 while it does comprise the step of ejecting ink from the nozzles 6 in core region 74.

Using such specially designed edge regions 76 is based on the understanding that the gas flow pattern generated by the ventilation openings tends to become inhomogeneous at the edge of the area covered by ventilation openings, i.e. leading to a non-homogeneous distribution of evaporated ink, and to non-uniform airflow patterns that may cause slight flight path deviations between the droplets ejected by different nozzles. Hence, for homogeneous printing results, it is advantageous not to have activatable nozzles in edge region 76.

As mentioned, there are no activatable nozzles in the edge region 76. This can e.g. be achieved by one or more of the following measures:

- omitting all nozzles in the edge region 76,
- providing nozzles in the edge region 76 but not connecting them to the ink source, and/or
- not providing the nozzles with nozzle electrodes 44 and/or not connecting the nozzle electrodes 44 to any voltage source and/or (in operation) not applying any voltage to these nozzle electrodes.

Advantageously, the print head is adapted and structured to generate a smaller gas flow rate through at least some of the ventilation openings 14', 16' in edge region 76 than through the ventilation openings 14, 16 in core region 74. This can e.g. be achieved, as illustrated in FIG. 11, by providing at least some of the ventilation openings in edge region 76 with a diameter smaller, in particular at least 5% smaller, than the ventilation openings 14, 16 in core region 74.

In such and similar cases with reduced gas flow ventilation openings at edge region 76, the method for operating the print head advantageously comprises feeding a larger amount of gas through at least some of the ventilation openings 14, 16 of core region 74 than through at least some of the ventilation openings 14, 16 of edge region 76, advantageously with an at least 20% smaller gas flow.

Notes

Apart from the nozzles 6 arranged in a regular array, print head 2 may comprise further nozzles outside said array, e.g. nozzles dedicated to special printing tasks. These further nozzles are advantageously fewer in number (e.g. no more than 10% of all nozzles) and they may or may not be provided with their own ventilation openings.

In the above examples, the unit cells 28 are squares. It must be noted, though, that they may also be mere rectangles. There is no strict need to have equal nozzle spacing in two perpendicular horizontal directions even though, depending on unit cell design, the higher geometry of a square over a rectangle may be advantageous for maintaining identical gas flows around the nozzles.

Figure 9:
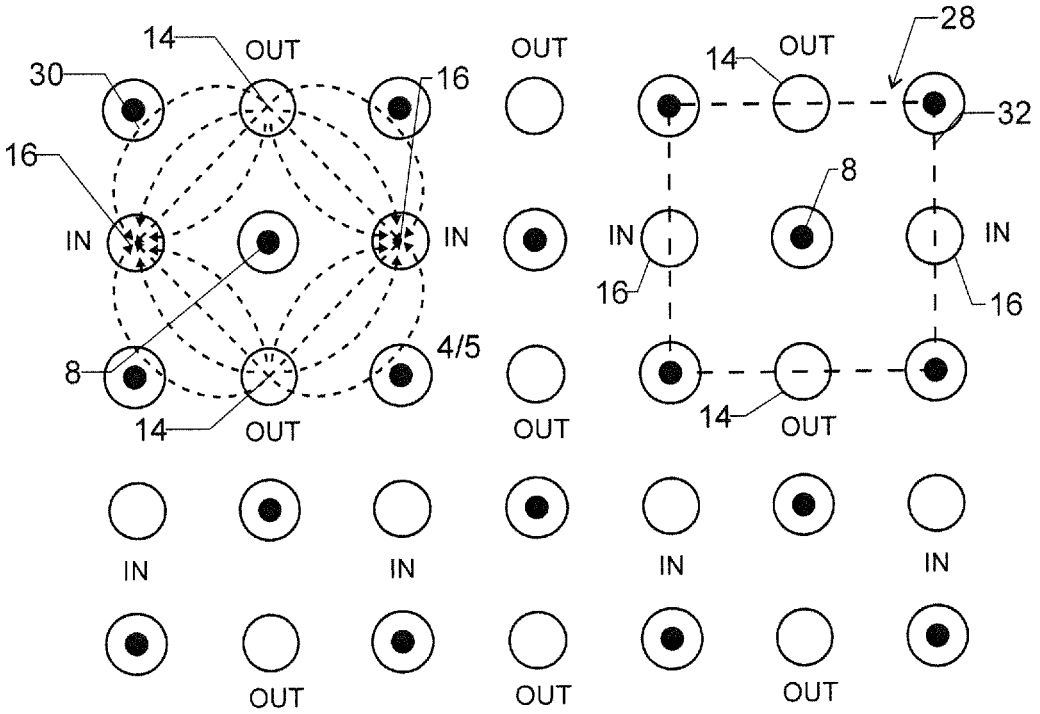
FIG. 9 shows a fourth arrangement of the nozzles and ventilation openings as seen from the bottom of the print head.

Equally, nozzles must not be placed in square-like fashion but may also be placed in a hexagonal fashion. For example, this would be achieved by adding a nozzle 8 to the print head 2 in FIG. 3 at all those positions that form the center of a square which has its edges situated at the position of four neighboring nozzles 8. In this way, the number of nozzles 8 on the print head would be doubled while the number of ventilation openings 14, 16 remains constant, i.e. there will be only one ventilation opening 14, 16 per nozzle 8, and hence there is no more symmetry at the level of a single nozzle, similar to the situation in FIG. 4. This is illustrated in FIG. 9.

Figure 10:
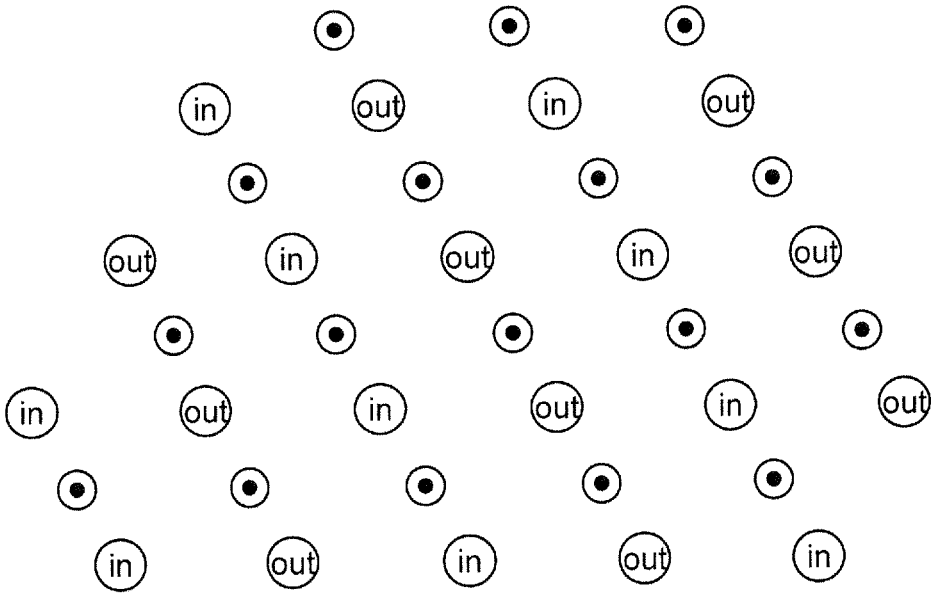
FIG. 10 shows a fifth arrangement of the nozzles and ventilation openings as seen from the bottom of the print head.

FIG. 10 finally illustrates a design with the nozzles arranged with 3-fold symmetry.

While there are shown and described presently preferred embodiments of the invention, it is to be distinctly understood that the invention is not limited thereto but may be otherwise variously embodied and practiced within the scope of the following claims.

The invention claimed is:

1. A print head for depositing ink on a substrate comprising:

a nozzle layer comprising a) a plurality of nozzles, and b) a plurality of ventilation openings extending through said nozzle layer;

a core region with activatable nozzles and ventilation openings; and an edge region with ventilation openings but without activatable nozzles, with a border extending between the core region and the edge region, wherein a distance from the border to the outmost ventilation openings of the edge region is at least two times an average internozzle distance in the core region along a direction perpendicular to the border.

2. The print head of claim 1, wherein said ventilation openings comprise suction openings for feeding gas away from a region adjacent to said nozzles and blow openings for feeding gas towards said region.

3. The print head of claim 1, further comprising an array of nozzles and, for each nozzle in said array, at least one ventilation opening, in particular exactly one ventilation opening, per nozzle.

4. The print head of claim 3, further comprising, for each nozzle in said array, at least two, in particular exactly two, ventilation openings per nozzle.

5. The print head of claim 3, wherein said array has a plurality of identical unit cells, with each unit cell comprising at least one nozzle and the same arrangement of ventilation openings.

6. The print head of claim 5, wherein each unit cell comprises at least part of a blow opening and at least part of a suction opening.

7. The print head of claim 6, wherein each unit cell consists of one blow opening, one suction opening, and one nozzle arranged between said blow opening and said suction opening, in particular at a center between said blow opening and said suction opening.

8. The print head of claim 6, wherein each unit cell consists of two halves of a blow opening and two halves of a suction opening alternatingly arranged at centers of edges of a rectangle and one nozzle in the center of the rectangle, and in particular wherein said rectangle is a square.

9. The print head of claim 1, further comprising ventilation ducts connected to said ventilation openings.

10. The print head of claim 9, wherein said ventilation ducts comprise interconnect ducts, with each interconnect duct interconnecting a plurality of said ventilation openings, and in particular wherein said interconnect ducts extend horizontally.

11. The print head of claim 10, wherein said ventilation openings comprise suction openings for feeding gas away from a region adjacent to said nozzles and blow openings for feeding gas towards said region, and wherein said print head comprises a first set of interconnect ducts interconnecting said blow openings and a second set of interconnect ducts interconnecting said suction openings.

12. The print head of claim 9, further comprising electrically conductive vias extending through at least part of said ventilation ducts.

13. The print head of claim 1, wherein said nozzle layer is a single, integral body.

14. The print head of claim 1, wherein said print head is an electrohydrodynamic print head comprising at least one nozzle electrode at each nozzle.

15. A printing system including a print head of claim 1.

16. The printing system of claim 15, further comprising a target holder, and at least one temperature control device for heating or cooling said print head and/or said target holder.

17. The printing system of claim 16, further comprising at least one of:

a print head temperature control device for cooling said print head or a target temperature control device for heating said target holder.

18. The printing system of claim 15, further comprising an ink circulation pump connected to said print head.

19. The printing system of claim 15, further comprising at least one mass flow controller for regulating a mass flow of a gas passing through the ventilation openings and/or a valve for controlling the flow of the gas.

20. The printing system of claim 15, further comprising an acceleration electrode to be associated with a target for generating a uniform electric field between the target and said print head for accelerating droplets ejected from any nozzle towards the target.

21. The print head of claim 1, wherein said edge region is several rows of ventilation openings deep.

22. The print head of claim 1, wherein a distance from the border to the outmost ventilation openings of the edge region is at least five times an average internozzle distance in the core region along a direction perpendicular to the border.

23. A print head for depositing ink on a substrate comprising:

a nozzle layer comprising a) a plurality of nozzles, and b) a plurality of ventilation openings extending through said nozzle layer; and an array of nozzles and, for each nozzle in said array, at least one ventilation opening, in particular exactly one ventilation opening, per nozzle, wherein said array has a plurality of identical unit cells, with each unit cell comprising at least one nozzle and the same arrangement of ventilation openings, wherein each unit cell comprises at least part of a blow opening and at least part of a suction opening, and wherein each unit cell consists of four quarters of suction openings at the corner of a first rectangle, four halves of blow openings at the middle of the edges of the first rectangle, one suction opening in the center of the first rectangle, and four nozzles at the corners of a second rectangle, wherein the first and second rectangles have parallel edges and are concentric, and wherein the first rectangle has twice the diameter of the second rectangle, and in particular wherein said rectangles are squares.

24. A print head for depositing ink on a substrate comprising:

a nozzle layer comprising a) a plurality of nozzles, and b) a plurality of ventilation openings extending through said nozzle layer; and a core region with activatable nozzles and ventilation openings and an outmost row of ventilation openings surrounding said core region, wherein the print head is adapted and structured to generate a smaller gas flow rate through at least some of the ventilation openings in the outmost row than through the ventilation openings in the core region.

25. A method for operating a print head, that includes a nozzle layer comprising a) a plurality of nozzles, and b) a plurality of ventilation openings extending through said nozzle layer, a core region with activatable nozzles and ventilation openings and an edge region with ventilation openings but without activatable nozzles, with a border extending between the core region and the edge region, in which a distance from the border to the outmost ventilation openings of the edge region is at least two times an average internozzle distance in the core region along a direction perpendicular to the border, the method comprising:

printing an ink onto a target by said nozzles, and conveying a gas through said ventilation openings.

26. The method of claim 25, wherein some of said ventilation openings are blow openings and other of said ventilation openings are suction openings, wherein said method further comprises:

feeding gas away from a region at said nozzles through said suction openings and feeding gas to said region through said blow openings, and in particular wherein gas is fed away from the region and fed to the region at the same time.

27. The method of claim 26, wherein a flow rate of gas conveyed through the blow openings into said region equals a flow rate of gas conveyed through the suction openings from said region.

28. The method of claim 25, wherein electrical fields from nozzle electrodes of the print head are used to eject said ink from said nozzles during printing.

29. The method of claim 25, further comprising controlling the temperature of at least one of the print head and the target.

30. The method of claim 29, further comprising maintaining the target at a higher temperature than the print head, and in particular with a temperature difference between the target and the print head of at least 10° C., in particular at least 30° C.

31. The method of claim 25, further comprising heating said target to at least 80° C.

32. The method of claim 25, further comprising:

feeding a gas through at least one inlet of the print head to a plurality of blow openings of the print head, wherein a flow resistance of the gas between the at least one inlet and the blow openings varies by less than 25%, in particular less than 5%, over all said blow openings.

33. The method of claim 25, further comprising: feeding a gas from suction openings of the print head through at least one outlet of the print head, wherein a flow resistance of the gas between the suction openings and the at least one outlet varies by less than 25%, in particular less than 5%, over all said suction openings.

34. The method of claim 25, wherein a distance from the border to the outmost ventilation openings of the edge region of the print head is at least five times an average internozzle distance in the core region along a direction perpendicular to the border.

* * * * *